US005460323A

United States Patent [19]

Titus

[11] Patent Number: 5,460,323

[45] Date of Patent: Oct. 24, 1995

[54] DISPOSABLE INSULATED CONTAINER

[75] Inventor: Jack H. Titus, Rohnert Park, Calif.

[73] Assignee: California Environmental Cup, Inc., Menlo Park, Calif.

[21] Appl. No.: 370,976

[22] Filed: Jan. 10, 1995

[51] Int. Cl.[6] ..... B65D 3/22

[52] U.S. Cl. ..... 229/403; 220/468; 229/4.5; 493/95; 493/152; 493/907

[58] Field of Search ..... 229/400, 403, 229/4.5; 220/410, 468, 469; 493/95, 98, 152, 154, 903, 907

[56] References Cited

U.S. PATENT DOCUMENTS

| | | | |
|---|---|---|---|
| 2,030,693 | 2/1936 | Eden | 493/95 |
| 3,082,900 | 3/1963 | Goodman | 229/403 |
| 3,456,860 | 7/1969 | Janninck | 229/400 |
| 3,908,523 | 9/1975 | Shikaya | 493/152 |
| 4,007,670 | 2/1977 | Albano . | |
| 4,040,537 | 8/1977 | Edwards . | |
| 4,261,501 | 4/1981 | Watkins . | |
| 4,435,244 | 3/1984 | Beck et al. | 156/379.8 |
| 4,548,348 | 10/1985 | Clements . | |
| 4,680,023 | 7/1987 | Varano | 493/75 |
| 5,071,060 | 12/1991 | DeFelice | 229/403 |
| 5,145,107 | 9/1992 | Silver et al. | 229/4.5 |
| 5,205,473 | 4/1993 | Coffin, Sr. | 493/907 |
| 5,226,585 | 7/1993 | Varano . | |
| 5,363,982 | 11/1994 | Sadlier | 493/152 |
| 5,385,260 | 1/1995 | Gatcomb | 229/400 |

FOREIGN PATENT DOCUMENTS

| | | |
|---|---|---|
| 2331005 | 1/1975 | Germany . |

*Primary Examiner*—Gary E. Elkins
*Attorney, Agent, or Firm*—Feix & Feix

[57] ABSTRACT

A disposable insulated container comprises an inner container structure and an outer wrap. The side wall portions of the inner container structure and the outer wrap have a configuration and a separation which provides an insulating chamber extending annularly about the spaced apart sidewalls of the container.

8 Claims, 3 Drawing Sheets

DISPOSABLE INSULATED CONTAINER

BACKGROUND OF THE INVENTION

This invention relates generally to a disposable insulated container.

This invention relates particularly to a disposable insulated container having an inner sidewall which is bowed inwardly and away from a straight tapered outer sidewall so that an insulating chamber is formed between the spaced apart sidewalls.

The disposable insulated container of the present invention is particularly adapted to contain hot liquids, such as, for example, beverages, soups and other food products.

U.S. Pat. No. 5,226,585 issued Jul. 13, 1993 discloses a disposable insulated container made of materials which are biodegradable.

This U.S. Pat. No. 5,226,585 is incorporated by reference in this application.

The container of the present invention is similar to the container of the U.S. Pat. No. 5,226,585 in that both containers utilize a construction in which the sidewalls of the container are specially configured to provide insulation for the contents contained within the container; but the configuration and function of the sidewall structure of the container of the present invention are, however, quite different from the structure disclosed in the U.S. Pat. No. 5,226,585.

SUMMARY OF THE INVENTION

The disposable container of the present invention comprises an inner container structure and an outer wrap. The outer wrap has upper and lower end portions attached to respective upper and lower end portions of the inner container structure.

The inner container structure has an open upper end portion providing an open top, a lower end portion providing a closed bottom, and a generally conically extending, arcuately inwardly bowed sidewall portion which provides a closed sidewall between the open top and the closed bottom.

The outer wrap has upper and lower end portions attached to respective upper and lower end portions of the inner container structure.

The outer wrap also has a straight tapered, conically extending sidewall portion which extends circumferentially around and in spaced apart relationship to the arcuately inwardly bowed sidewall portion of the inner container structure.

An annular, enclosed, insulating cavity is formed between the respective spaced apart sidewall portions of the inner container structure and the outer wrap.

The arcuately inwardly bowed sidewall portion has a curvature which is large enough to provide the annular, enclosed, insulating cavity.

The curvature of the arcuately inwardly bowed sidewall portion is small enough to permit effective stacking of a plurality of identically dimensioned containers.

A container which embodies the features described above and which is effective to function as described above comprises specific objects of the present invention.

Other and further objects of the present invention will be apparent from the following description and claims and are illustrated in the accompanying drawings, which by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

BRIEF DESCRIPTION OF THE DRAWING VIEWS

FIG. 1 is partially broken away and shown in cross section to illustrate details of construction.

Figure 4:
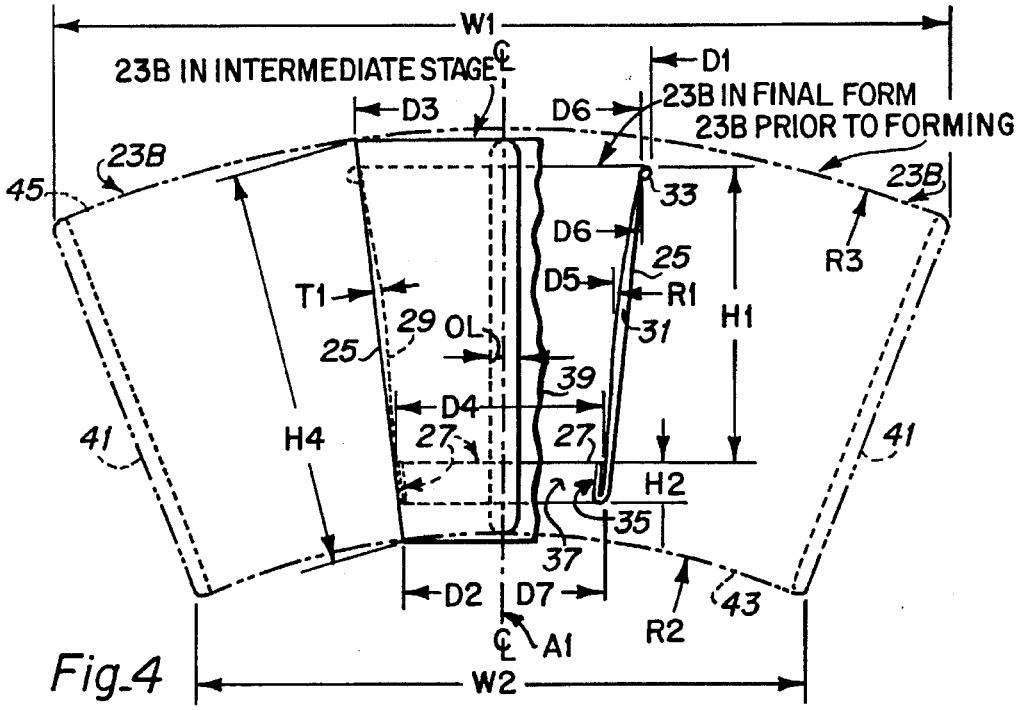
FIG. 4 is a composite view showing three stages in the sequence of formation of the blank for the inner container structure.

In the first, initial stage the blank is a flat blank as shown in the outline in the plan view in FIG. 4.

In the second, intermediate stage the blank has been formed to the generally conical configuration having an arcuately, inwardly curved side wall. This second, intermediate stage is shown in the fragmentary side elevation view in the left central portion of FIG. 4. In this second, intermediate stage the blank has not yet had the top end formed to the rolled rim configuration and has not yet had the lower end formed to the folded skirt configuration.

In the final stage the blank has been formed to have the rolled rim at the open upper end of the inner container and has been formed to have the lower, folded skirt configuration at the lower end portion of the inner container. This stage is shown in the fragmentary side elevation view in the right central portion of FIG. 4.

Figure 1:
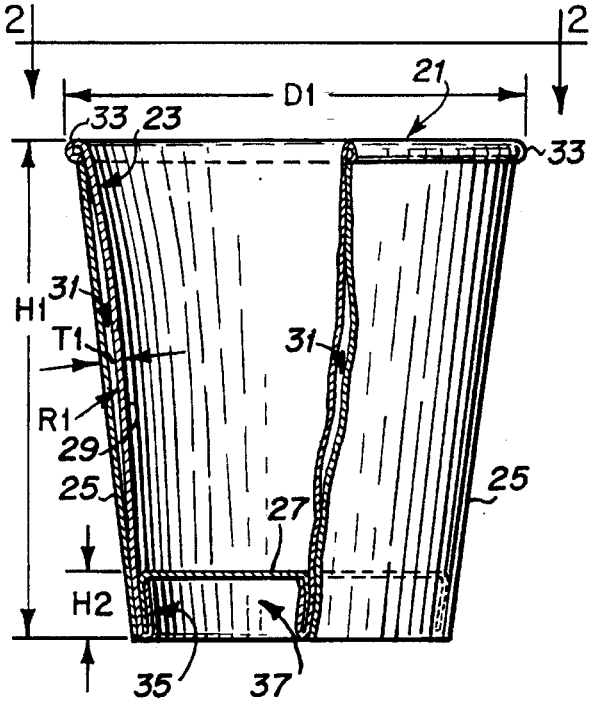
FIG. 1 is a side elevation view of a disposable insulated container constructed in accordance with one embodiment of the present invention.
Figure 2:
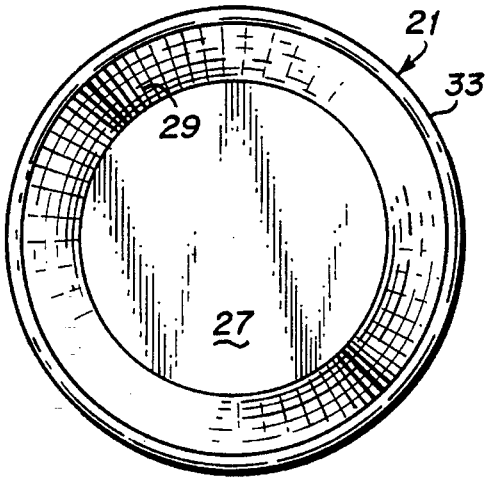
FIG. 2 is a top plan view of the container shown in FIG. 1.
Figure 5:
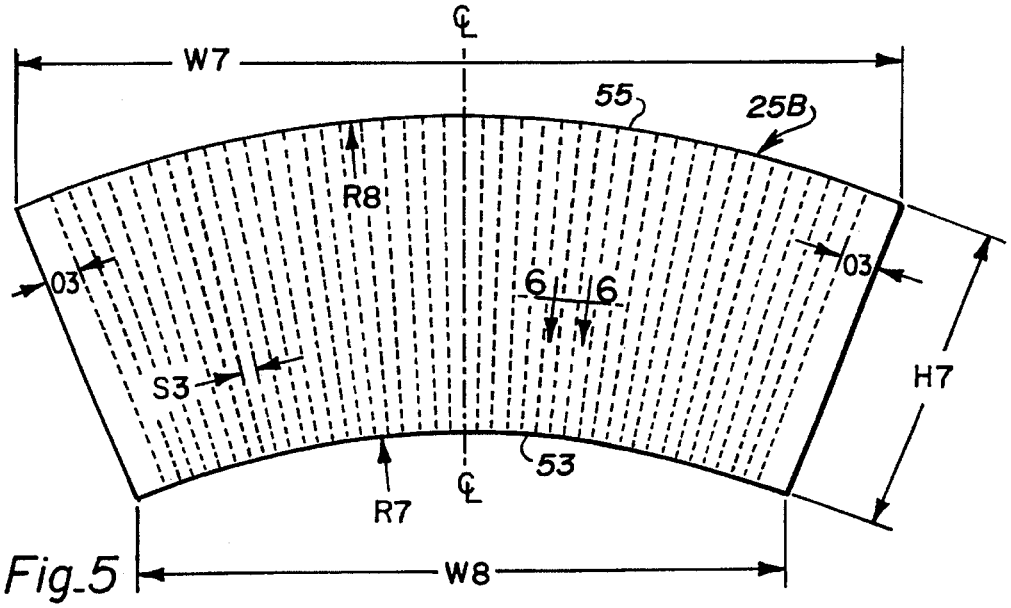

FIG. 5 is a plan view of an outer wrap blank used to provide the outer side wall of the container shown in FIG. 1. FIG. 5 is a plan view of the outside surface of the outer wrap blank. The outer wrap blank may have smooth outer and inner surfaces (as illustrated in FIGS. 1–4); but FIG. 5 also indicates, in phantom lines, how the outside and inside surfaces of the outer wrap blank may be configured to provide a vertically ribbed configuration in one alternative embodiment of the present invention.

Figure 6:
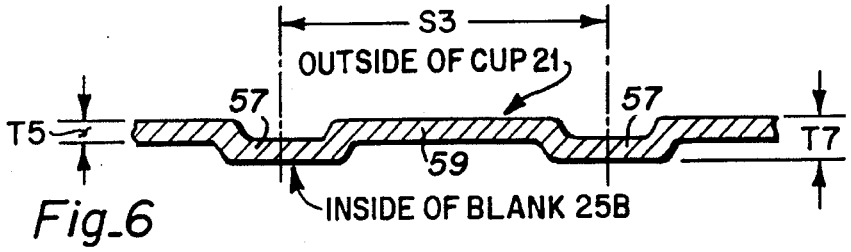

FIG. 6 is a fragmentary, enlarged, elevation view in cross section of a portion of the alternative, ribbed embodiment of the wrap blank shown in FIG. 5. FIG. 6 is taken along the line and in the direction indicated by the arrows 6—6 in FIG. 5.

Figure 7:
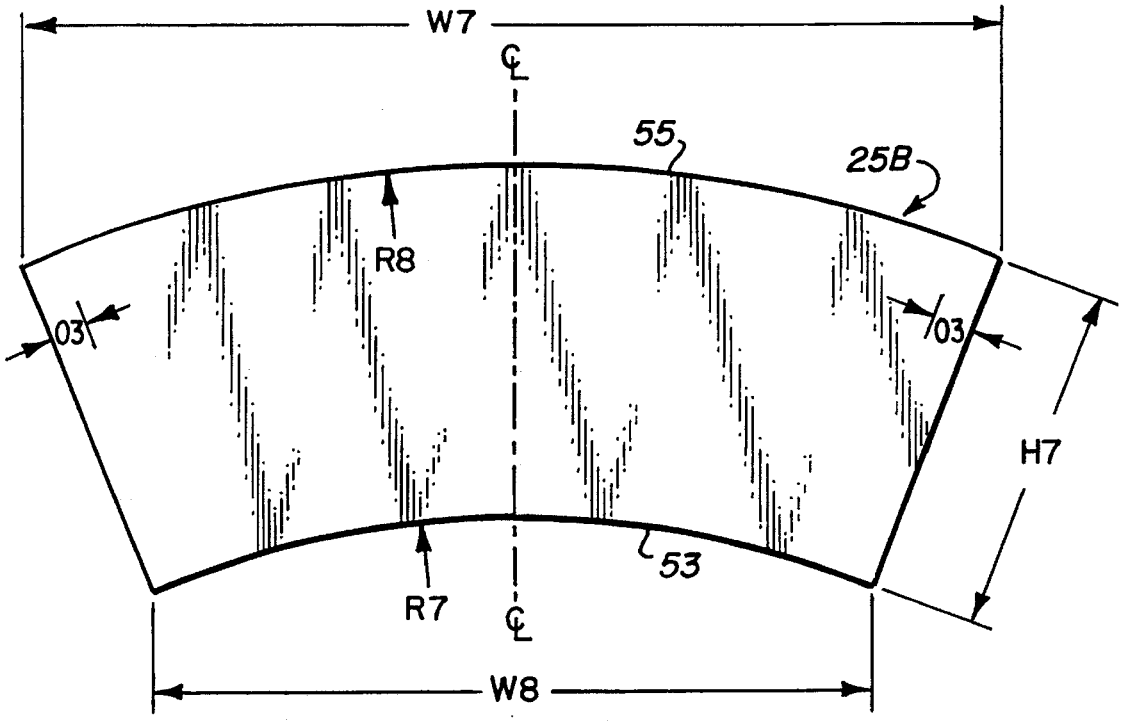

FIG. 7 is a plan view of an outer wrap blank (like FIG. 5) having smooth outer and inner surfaces.

DETAILED DESCRIPTION OF THE PREFERRED EMBODIMENTS

A disposable, insulated container constructed in accordance with one embodiment of the present invention is indicated generally by the reference numeral 21 in FIG. 1.

The container 21 comprises an inner container structure 23 and an outer wrap 25.

The inner container structure has an upper end portion which provides an open top, a lower end portion which includes a closed bottom 27, and a sidewall portion 29. The sidewall portion 29 is shaped generally as a truncated cone but has an arcuately inwardly bowed configuration.

The inwardly bowed side wall portion 29 provides a closed side wall between the open top and the closed bottom 27.

It is a key feature of the present invention that the arcuately inwardly bowed configuration of the side wall portion 29 separates and spaces that side wall portion 29 away from the straight, tapered, conically extending side wall portion of the outer wrap 25.

The separation and spacing provide a unique and effective insulating chamber or cavity 31 between the respective side wall portions of the inner container structure 23 and the outer wrap 25.

This insulating chamber 31 is an annular, enclosed, insulating chamber which extends entirely around the container 21.

It is another important feature of the present invention that the amount of the curvature of the inwardly bowed side wall 29 is large enough to provide the annular, insulating space, but that the amount of the curvature is small enough to permit effective stacking of a plurality of identically-dimensioned containers.

Figure 3:
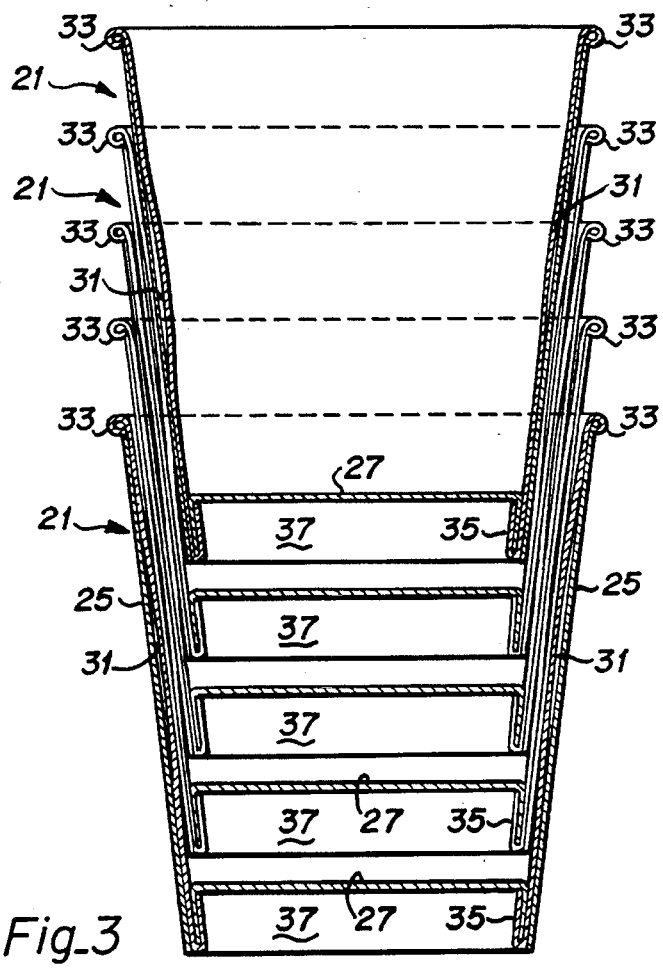
FIG. 3 is a side elevation view in cross section showing how a plurality of identically dimensioned containers constructed in accordance with the FIG. 1 embodiment can be stacked.

The stacking is illustrated in FIG. 3.

Specific structural features and specific dimensions and methods of assembly of the container 21 will be described in more detail below with specific reference to FIGS. 4 and 5.

The container 21 is formed of three blanks.

The three blanks comprise an inner blank 23B (see FIG. 4) for the inner container 23, an outer blank 25B (see FIG. 5), for the outer wrap 25, and a bottom, circular blank 27B for the bottom 27.

The three blanks are heat sealed at specific locations, as will be described in more detail below.

The sequence of assembling the three blanks is quite similar to the sequence illustrated and described in U.S. Pat. No. 5,226,585 issued Jul. 13, 1993.

The configuration and function of the arcuately inwardly bowed sidewall portion 29 of the container 21 of the present invention are, however, quite different from the container structure disclosed in U.S. Pat. No. 5,226,585.

The U.S. Pat. No. 5,226,585 is incorporated by reference in this application.

With continued reference to FIG. 1, the open top of the container 21 may be formed with a rolled rim 33, as illustrated in FIG. 1.

In some instances, depending upon the intended application of the container 21, the top of the container may be formed with a folded over top edge rather than the rolled rim 33 illustrated.

As illustrated in FIG. 1, the bottom wall 27 is supported above the level of the lowermost part of the container 21 by a stand, or skirt support structure 35. The structure 35 is formed by bending, and heat sealing together, the related, folded over, bottom edge portions of the inner blank 23B, the outer blank 25B and a circular shaped bottom blank 27B, as will be described in more detail below.

The structure 35 for supporting and positioning the bottom wall 27 upwardly above the lower most edge of the container provides an insulating space 37 below the bottom wall 27.

The container 21 may be fabricated into a number of industry standard sizes. For example, the container 21 may be fabricated to have an industry standard eight ounce, ten ounce, fifteen ounce or sixteen ounce capacity.

The specific dimensions will of course vary depending upon the size of the container.

In the description to follow, one specific container size will be discussed in detail, and particular dimensions will be described for that specific container size.

In one specific embodiment of the present invention the container 21 is an eight ounce capacity container, and the overall height H1 of the container is 4.12 inches, the outside diameter D1 of the rolled edge 33 is 3.8 inches, and the height H2 of the skirt 35 is 0.486 inches.

In the specific embodiment the maximum thickness T1 of the cavity 31 is 0.0582 inches.

The curvature of the inner wall had a radius R1 of 11.34 inches.

The container 21 was formed from blanks of paper which are coated with a single ply of polyethylene on at least one side of each blank.

The thickness of the paper stock is 0.014 inch.

Further details of specific dimensions for this specific embodiment will be discussed in more detail below with reference to FIG. 4 and FIG. 5.

The structure and sequence of steps involved in producing the inner container 23 will now be described with particular reference to FIG. 4.

As noted above in the brief description of the drawing views, FIG. 4 is a composite view.

The information set out and illustrated in the three composite portions of FIG. 4 alone is so extensive and complete that a container fabricator could fabricate the container 21 just from the information contained in the FIG. 4 view.

FIG. 4 shows a single blank 23B as cut from a sheet of stock. The sheet of stock is used to provide a plurality of identical blanks 23B. The blank 23B in FIG. 4 is shown flat in its peripheral edge outlines 41, 43 and 45.

The flat blank 23B as cut is ready for the first stage in the sequence of forming the blank to the inner container structure 23.

FIG. 4 (as noted above) is a composite view and also shows the blank 23B as it exists in a second intermediate form of fabrication prior to being formed to its final configuration. This intermediate stage is shown in the left central portion of FIG. 4 on the left hand side of the broken away line 39 in FIG. 4. In this second, intermediate stage the blank has been formed to the generally frusto conical configuration having the arcuately inwardly curved sidewall portion 29.

This stage of formation of the blank is produced by wrapping the blank 23B around a mandrel and clamping the blank to the mandrel with a clamp to form the blank to the shape of the mandrel. The mandrel has an external surface configuration and dimensions (described immediately below with reference to the blank 23B) for producing the novel, inwardly bowed sidewall portion 29.

For the specific eight ounce capacity embodiment of the present invention (in which the container has an overall height H1 of 4.12 inches) referred to above, the diameter D2 at the lower most edge of the blank (as formed in the intermediate stage) is 2.406 inches; the diameter D3 of the upper most end of the intermediate stage is 3.622 inches; the diameter D4 at the location of the bottom wall 27 is 2.652 inches; the diameter D5 at the location where the inwardly bowed sidewall transitions to a straight sidewall is 2.895 inches; and the diameter D6 at the location where the upper end portion is rolled over is 3.541 inches.

The radius R1 of the curvature of the inwardly bowed sidewall portion 29 is 11.3403 inches.

For purposes of illustrating how the structure of outer wrap 25B coacts with the structure of the wrap 23B in the completely assembled container 21, the outer wrap 25 has also been shown both in the intermediate stage view and in the final stage view in FIG. 4. But it should be noted that the outer wrap 25 actually is not assembled to the inner blank 23B (used to form the inner container 23) until after this inner container 23 has been fully formed.

The blank 23B is shown in its final form in the fragmentary side elevation view in the right central portion of FIG. 4.

The blank 23B is shown, in this portion of the composite view of FIG. 4, with the rolled bead 33 at the open upper end of the inner container 23.

The blank 23B is also shown in its assembled relation with the outer wrap 25 and in its assembled relation with the blank 27B as finally formed for the bottom wall 27.

This fully assembled stage of the blank 23B is shown with the blank 23B folded over (and doubled over a related lower edge, flange portion of the bottom blank 27B) to form the bottom stand or skirt structure 35.

The folded over lower edge portions of the blank 23B and the bottom blank 27B preferably both have polyethylene coatings which are heated to seal the engaged surfaces together to form a fluid tight seal.

The diameter D7 of the lower end of the finished container 21 has a diameter of 2.557 inches.

The height H2 of the bottom wall 27 from the lower most edge of the bottom stand 35 is 0.486 inches.

The maximum thickness T1 of the annular cavity 31 is 0.0582 inches.

Going back to the plan view showing (in FIG. 4) of the blank 23B prior to the first step in the forming on the mandrel, the maximum width W1 at the top end of the blank 23B is 11.494 inches.

The width W2 at the lower end portion of the blank 23B is 7.767 inches.

The angle A1 between the centerline CL and the outer edge 41 of the blank 23B is 21 degrees 56 minutes.

The radius of curvature R2 of the lower edge 43 of the blank 23B is 9.931 inches.

The radius R3 of the upper edge 45 of the blank 23B is 14.919 inches.

The height H4 of the generally frusto conically formed blank 23B in the intermediate stage (from the lower edge 43 to the upper edge 45) is 4.988 inches.

The outer edge portions of the blank 23B are overlapped in a dimension OL which has a thickness of 0.375 inches. This overlap OL is produced as the blank 23B is wrapped around the mandrel.

The overlap is sealed by heating the polyethylene coating in this area prior to overlapping the edge portions of the blank mandrel. The heated edge portions bond together very quickly when the edge portions are overlapped and clamped together.

The natural elasticity of the paper stock may be sufficient to form the rolled bead 33.

If the paper stock is not sufficiently elastic, this portion of the blank 23B may be sprayed with a silicon spray or some other suitable spray that will act as a lubricant (and possibly help to break up some of the fibers, if necessary) to form the rolled rim 33.

The outer wrap blank 25B is shown in FIGS. 5 & 6.

The outer wrap blank 25B may be a sheet of plain paper stock with a smooth outer and inner surfaces. This embodiment is illustrated in FIGS. 1–4 and FIG. 7.

In an alternatively embodiment the outer wrap blank 25B may have a ribbed configuration similar to the outer wrap blank 28 of the U.S. Pat. No. 5,226,585 issued Jul. 13, 1993 and incorporated by reference (as noted above) in this application.

This ribbed configuration is indicated by the phantom lines in FIG. 5.

The ribbed configuration is shown in detail in the fragmentary, enlarged, elevation view of FIG. 6.

In both embodiments the outer wrap 25B has the same dimensions on the outer periphery.

For the specific embodiment of the eight ounce capacity container 21 described above with particular reference to FIG. 4, the outer wrap blank 25B has an overall upper width W7 of 11.182 inches and has an overall lower width W8 of 8.209 inches.

In this specific embodiment the outer wrap blank 25B has a height H7 of 3.979 inches.

The edge portions of the outer wrap 25B have an overlap portion O3 of 0.438 inches width.

The radius R7 of curvature of the lower edge 53 is 10.601 inches, and the radius of curvature R8 of the upper edge 55 is 14.58 inches.

The thickness T5 (see FIG. 6) of the paper stock from which the outer wrap blank 25B is formed is 0.014 inches.

In the specific embodiment illustrated in FIG. 6 the vertically ribbed structure of the outer wrap blank 25 is formed by pressing the paper stock to have a configuration of vertically extending ribs 57 which project inwardly toward the inner container 23 and to have outwardly projecting vertically extending ribs 59 which are positioned on the outside of the cup 21.

The outwardly projecting ribs 59 are manually engaged by a person holding the cup 21.

The centerline to centerline spacing S3 between two adjacent inwardly projecting ribs 57 is 0.229 inches at the location indicated in FIG. 5. See FIG. 5 and FIG. 6.

As illustrated in FIG. 6, the overall thickness T7 of the outer wrap with the ribbed configuration is 0.027 inches.

In the fabrication of the cup 21 the last step is the wrapping of the outer wrap 25B about the inner, formed container 23. The polyethylene coating on the edge portions O3 of the outer wrap are heated, and these edge portions bond together when the edge portions are overlapped and pressed together. The lower portions of these heated edge margins O3 also bond to the lower skirt or stand portion 35.

While specific dimensions have been set forth for one particular eight ounce capacity cup or container 21, it will be recognized that the features of the present invention are applicable to other size containers with appropriate changes in dimensions.

While I have illustrated and described the preferred embodiments of our invention, it is to be understood that these are capable of variation and modification, and I therefore do not wish to be limited to the precise details set forth, but desire to avail myself of such changes and alterations as fall within the purview of the following claims.

I claim:

1. A disposable, insulated container comprising, an inner container structure having an upper end portion providing an open top, a lower end portion providing a closed bottom, and a generally conically extending, arcuately inwardly bowed side wall portion providing a closed side wall between the open top and the closed bottom, an outer wrap having upper and lower end portions attached to the respective upper and lower end portions of the inner container structure and having a straight tapered, conically extending side wall portion which extends circumferentially around and in spaced-apart relationship to said arcuately inwardly bowed side wall portion of the inner container structure to provide an annular, enclosed, insulating cavity between the respective side wall portions of the inner container structure and the outer wrap.

2. The container defined in claim 1 wherein the outer wrap is formed from a blank which has planar inner and outer surfaces and wherein the annular, enclosed, insulating cavity extends along substantially the full height of said side wall portions and is free of any structure within the annular space between said spaced-apart side wall portions.

3. The container defined in claim 1 wherein the outer wrap is formed from a blank having a vertically scored, ribbed inner and outer surfaces and wherein the inwardly projecting ribs extend into the annular space between said spaced-apart side wall portions.

4. The container defined in claim 1 wherein the arcuately, inwardly bowed side wall portion has a curvature large enough to provide said annular, enclosed, insulating cavity but has a curvature small enough to permit effective stacking of a plurality of identically dimensioned containers.

5. The container defined in claim 4 wherein the maximum width of said annular cavity is in the range of 0.05 inch to 0.10 inch for containers which have a depth between the open top and the closed bottom in the range of 3 inches to 8 inches.

6. The container defined in claim 1 wherein both the inner container structure and the outer wrap are made of paper.

7. The container defined in claim 6 wherein the paper has a single ply polyethylene coating on at least one surface.

8. A method of making a disposable, insulated container having an annular, insulating cavity enclosed between side wall portions of the container, said method comprising, cutting a first, flat, inner container blank with a peripheral configuration which enables the first blank to be formed to an inner container structure having an upper end portion providing an open top, a lower end portion providing a closed bottom, and a generally conically extending, arcuately inwardly bowed side wall portion providing a closed side wall between the open top and the closed bottom, forming the first blank to said inner container structure, cutting a second, outer wrap blank to a peripheral configuration and with dimensions which enable the second blank to be formed to an outer wrap having upper and lower end portions attached to the respective upper and lower end portions of the inner container structure and having a straight tapered, conically extending side wall portion which extends circumferentially around and in spaced-apart relationship to said arcuately inwardly bowed side wall portions of the inner container structure to provide an annular, enclosed, insulating cavity between the respective side wall portions of the inner container structure and the outer wrap, forming the second blank to said outer wrap, and attaching the outer wrap to the inner container structure to complete the fabrication of the container having the insulating cavity between the side wall portions of the container.

* * * * *